United States Patent [19]

Berry

[11] 4,402,459

[45] Sep. 6, 1983

[54] SPRAY GUN RECIPROCATING DEVICE

[76] Inventor: Arnold R. Berry, 89 Bradley Grove, Mitchell Park, Australia, 5043

[21] Appl. No.: 304,471

[22] Filed: Sep. 22, 1981

[30] Foreign Application Priority Data

Sep. 22, 1980 [AU] Australia ..... PE5683

[51] Int. Cl.[3] ..... B05B 3/18

[52] U.S. Cl. ..... 239/186

[58] Field of Search ..... 239/178, 184, 186, 185, 239/187; 134/172; 118/323

[56] References Cited

U.S. PATENT DOCUMENTS 2,728,238 12/1955 Paasche ..... 239/187 X 4,235,421 11/1980 Phillips ..... 239/186 X

*Primary Examiner*—John J. Love

*Assistant Examiner*—Mary McCarthy

*Attorney, Agent, or Firm*—Townsend and Townsend

[57] ABSTRACT

A reciprocating mechanism for applying a reciprocating action to a spray gun comprising a chain multiplier wherein a chain has two ends secured to respective chain anchors and extending over sprockets to have a portion extending between those sprockets, and spray gun mounting means secured to said portion, the chain multiplier being actuated by a ram, so arranged that upon tensioning of the chain, the spray gun mounting means is caused to move even when there is only minute movement of the chain, this being effective to greatly reduce the tendency of the chain to shudder.

4 Claims, 8 Drawing Figures

SPRAY GUN RECIPROCATING DEVICE

This invention relates to a device for applying a reciprocating action to a spray gun, and although not limited to a spray gun of the electrostatic type, is particularly useful for controlling movement of such a gun.

BACKGROUND OF THE INVENTION

Several difficulties are encountered with reciprocating devices for the reciprocating of spray guns. One of the difficulties which is encountered is the tendency of the gun to shudder as it moves along the tracks, and one object of this invention is to provide means whereby the movement of a gun will be very smooth.

Another difficulty which is encountered is that reciprocating devices which have been used heretofore have often required extensions of tracks both below the ground level and above the roof level of a building, with consequential high costs, and another object of this invention is to provide an effective reciprocating device of low cost.

A further difficulty encountered is the "dwell" at the end of a stroke which results in excessive application of paint to a workpiece, and another object of the invention is to provide improvements whereby dwell time is very short.

Still further, during horizontal movement of various prior art devices the vibrations cause dirt to be shaken loose and fall upon the work being painted, whilst in numerous vertical types, the gun must travel the complete stroke length requiring the gun to be turned on and off as it passes the work causing excessive "W" patterns because of the lost time at the beginning and end of each stroke. A further object of this invention is to provide improvements which will obviate these problems.

BRIEF SUMMARY OF THE INVENTION

Briefly in this invention a spray gun reciprocating device comprises a chain multiplier wherein a chain has two ends secured to respective chain anchors and extending over sprockets to have a portion extending between those sprockets, and spray gun mounting means is secured to that portion, the chain multiplier being actuated by a ram.

The chain can be tensioned so that the spray gun mounting means on the chain is caused to move even when there is only minute movement of the chain and this has been found to be effective in greatly reducing the tendency to shudder. However to still further reduce that tendency, in one embodiment of the invention there is provided a pair of pressure accumulators each containing oil on its lower portion and air in its upper portion, and movement of the chain is effected by controlling air pressure over the oil. This greatly adds to the smoothness of operation because of the fluid friction of oil and its incompressible nature, as it moves through conduits and rams.

More specifically, in one aspect the invention comprises a frame, a pressure-fluid actuated ram assembly having two relatively movable sub-assemblies, one said sub-assembly comprising a cylinder and the other said sub-assembly comprising a piston, mounting means securing one of said sub-assemblies to said frame, a twin sprocket carrier on the other said sub-assembly, and a pair of driving sprockets mounted for rotation on said sprocket carrier, a first chain anchor on said frame located at a first position away from said sprocket carrier and a second chain anchor on said frame located at a second position away from said sprocket carrier, at least one of said anchors embodying tension means, idler sprockets mounted for rotation with respect to the frame, a chain having two ends secured to respective said chain anchors and extending over said sprockets to have a portion extending between said idler sprockets, and spray gun mounting means secured to said chain portion.

BRIEF DESCRIPTION OF THE DRAWINGS

Embodiments of the invention are described hereunder in some detail with reference to and are illustrated in the accompanying drawings in which.

Figure 1:
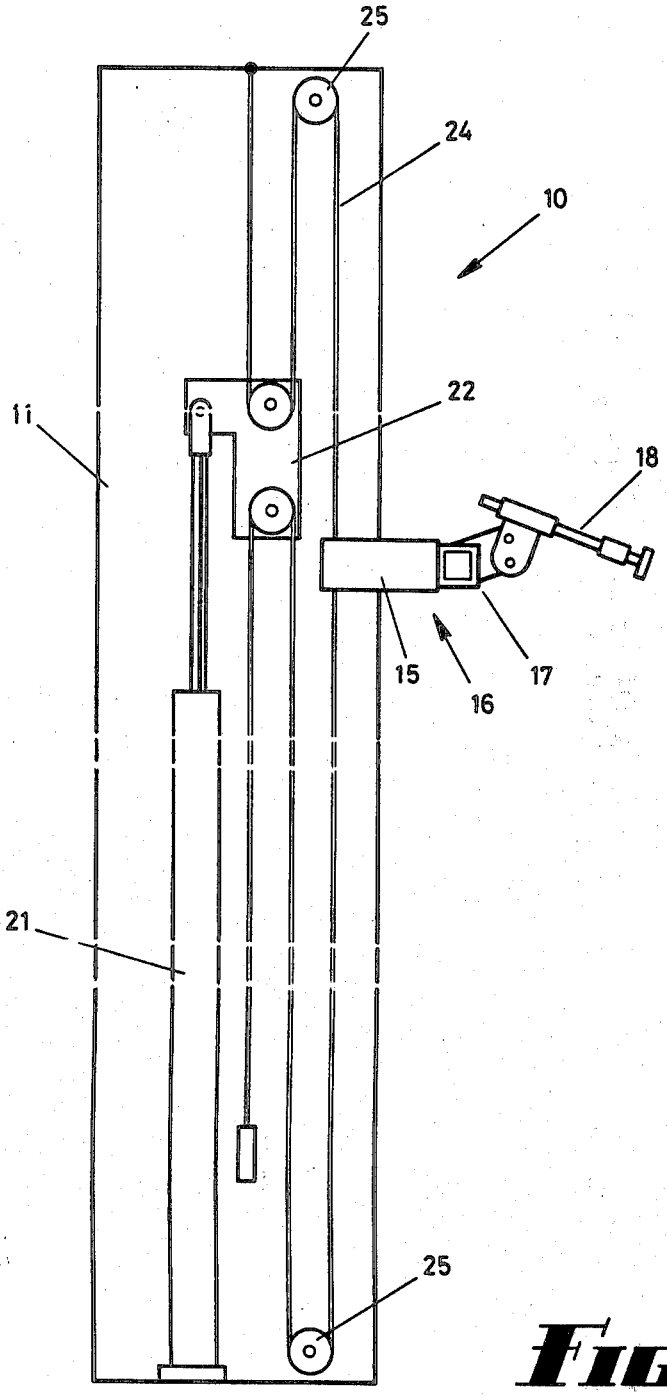
FIG. 1 is a diagrammatic representation of a reciprocating device wherein a gun is moved in a vertical direction by a chain multiplier having a 2:1 ratio with respect to a ram.

Referring to the first embodiment, a spray gun reciprocating device 10 comprises a frame 11 having an access door 12, and one wall 13 containing a slot 14 for movement of a bracket 15 of spray gun mounting means 16 to which is attached a transverse arm 17 carrying a pair of spray guns 1 (only one of which would be used at that time).

To effect movement of the mounting means 16 together with its spray guns 18 there is provided an hydraulic ram 21, the cylinder sub-assembly of which extends upwardly from the base of the frame 11 and the piston sub-assembly of which is coupled to a sprocket carrier 22 which carries on it a pair of sprockets 23 around which a chain 24 extends. The chain 24 also passes over idler sprockets 25 positioned respectively above and below the mounting means 16 which is secured thereto. The two ends of the chain 24 are provided with respective tensioning means 26 shown in FIG. 2, and in use it is important that the chain should be tensioned so that very small movement of the piston sub-assembly of the arm 21 will cause corresponding movement of the mounting means 16.

Figure 3:
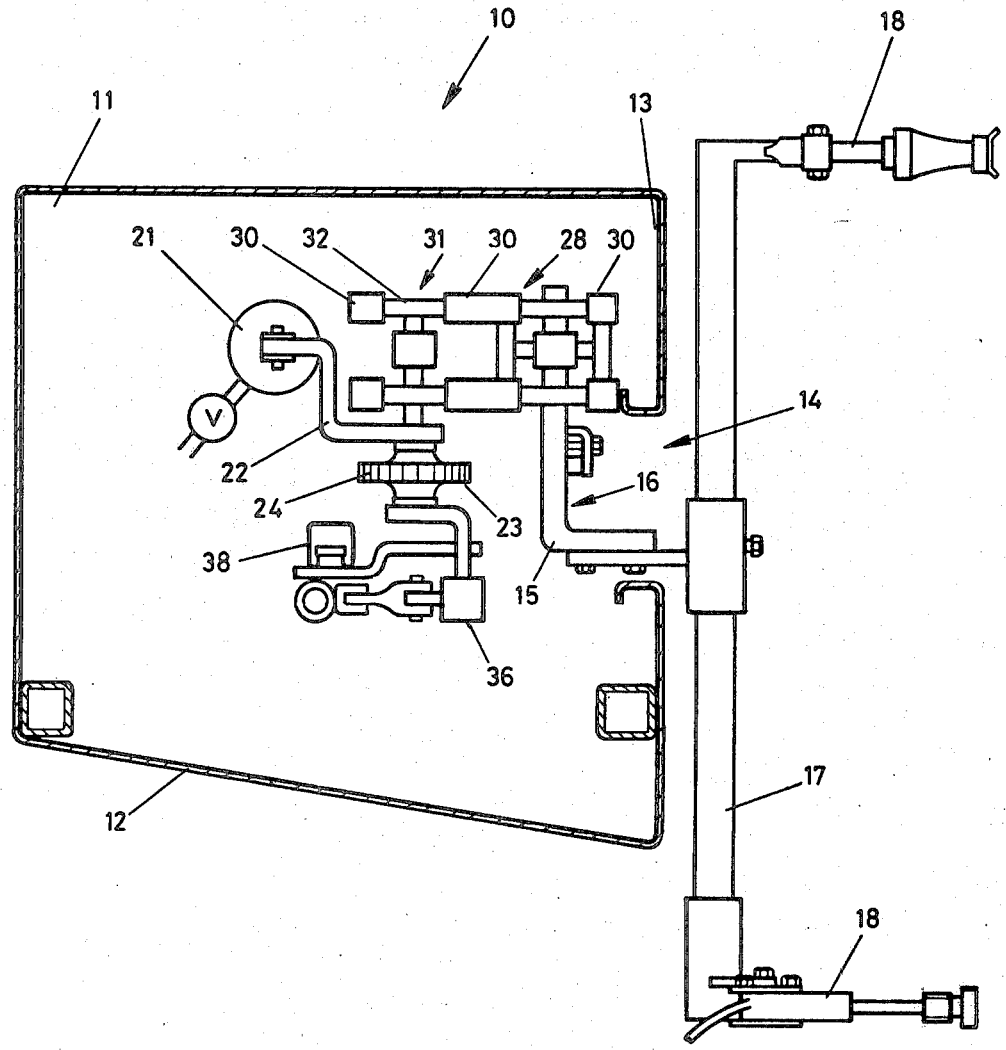
FIG. 3 is a section taken on line 3—3 of FIG. 2.
Figure 4:
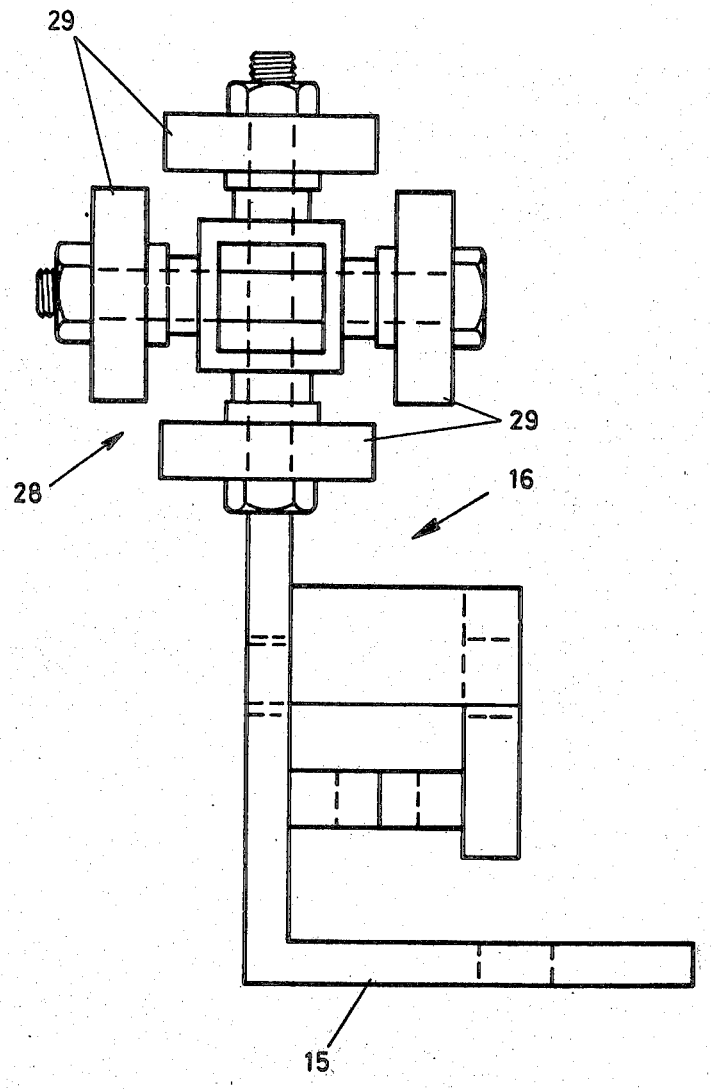
FIG. 4 is a view showing the gun mounting means comprising a carriage.
Figure 5:
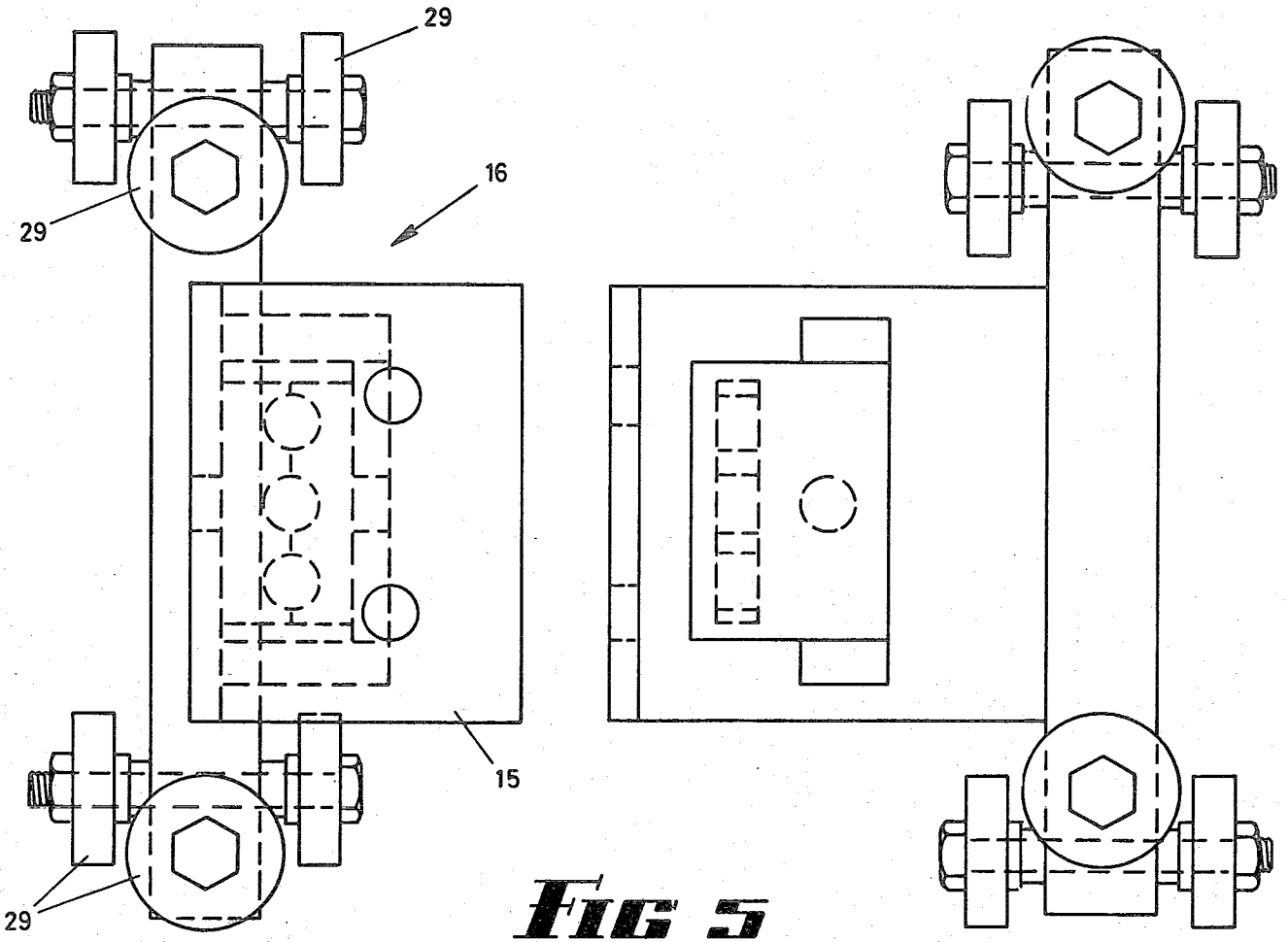
FIG. 5 is a front elevation of FIG. 4.

The mounting means 16 comprises a carriage 28 shown in detail in FIGS. 4 and 5, the carriage 28 being provided with rollers 29 which are freely rotatable with respect to the carriage 28 and which engage tracks 30. The sprocket carrier 22 also is carried on a carriage designated 31 which also has rollers 32 engaging the tracks 30. As can be seen best in FIG. 3 the tracks 30 comprise two parallel rows each containing three vertically extending tubular members.

Figure 2:
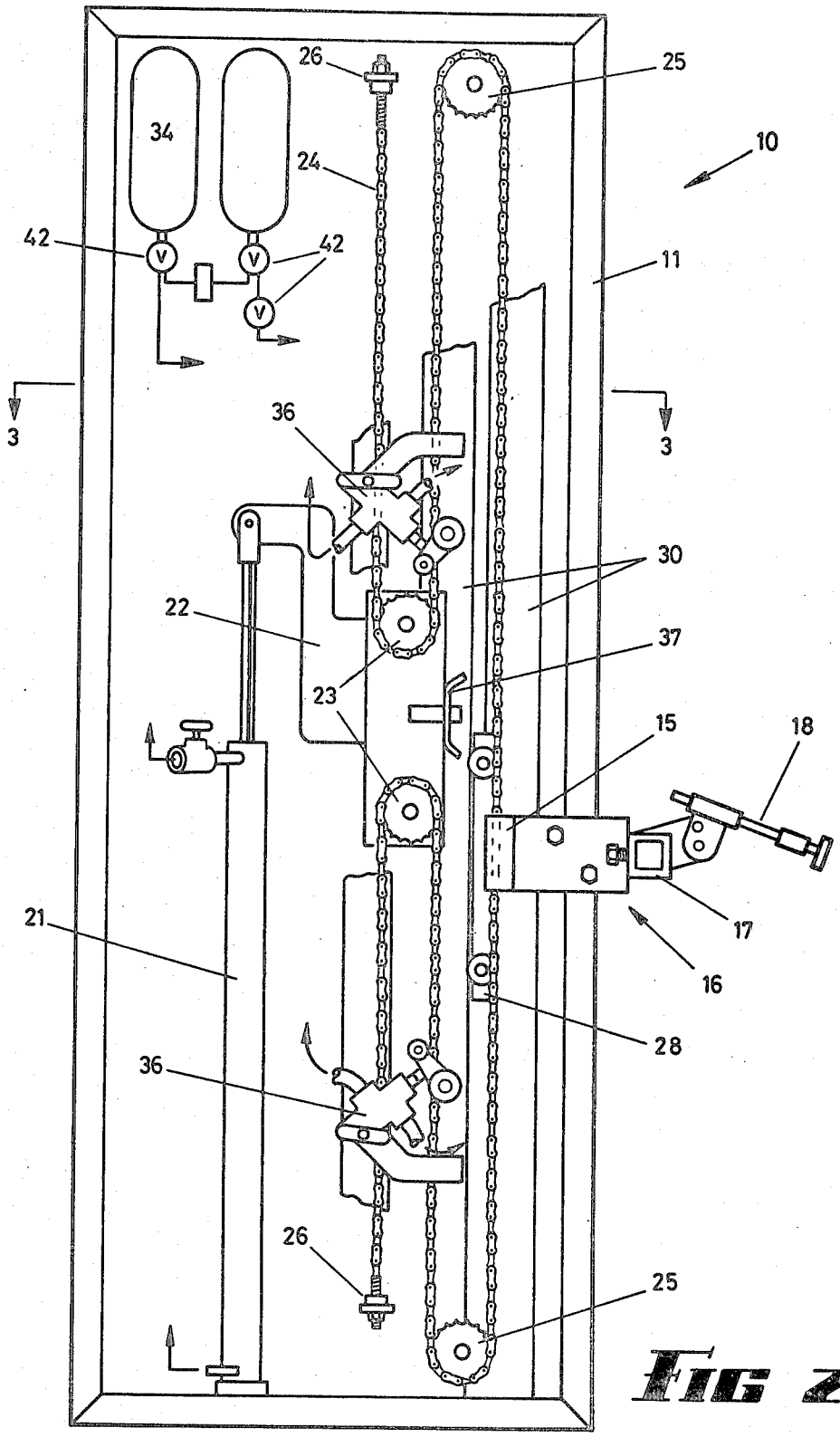
FIG. 2 is an elevational view showing details of construction of the arrangement illustrated in FIG. 1.
Figure 6:
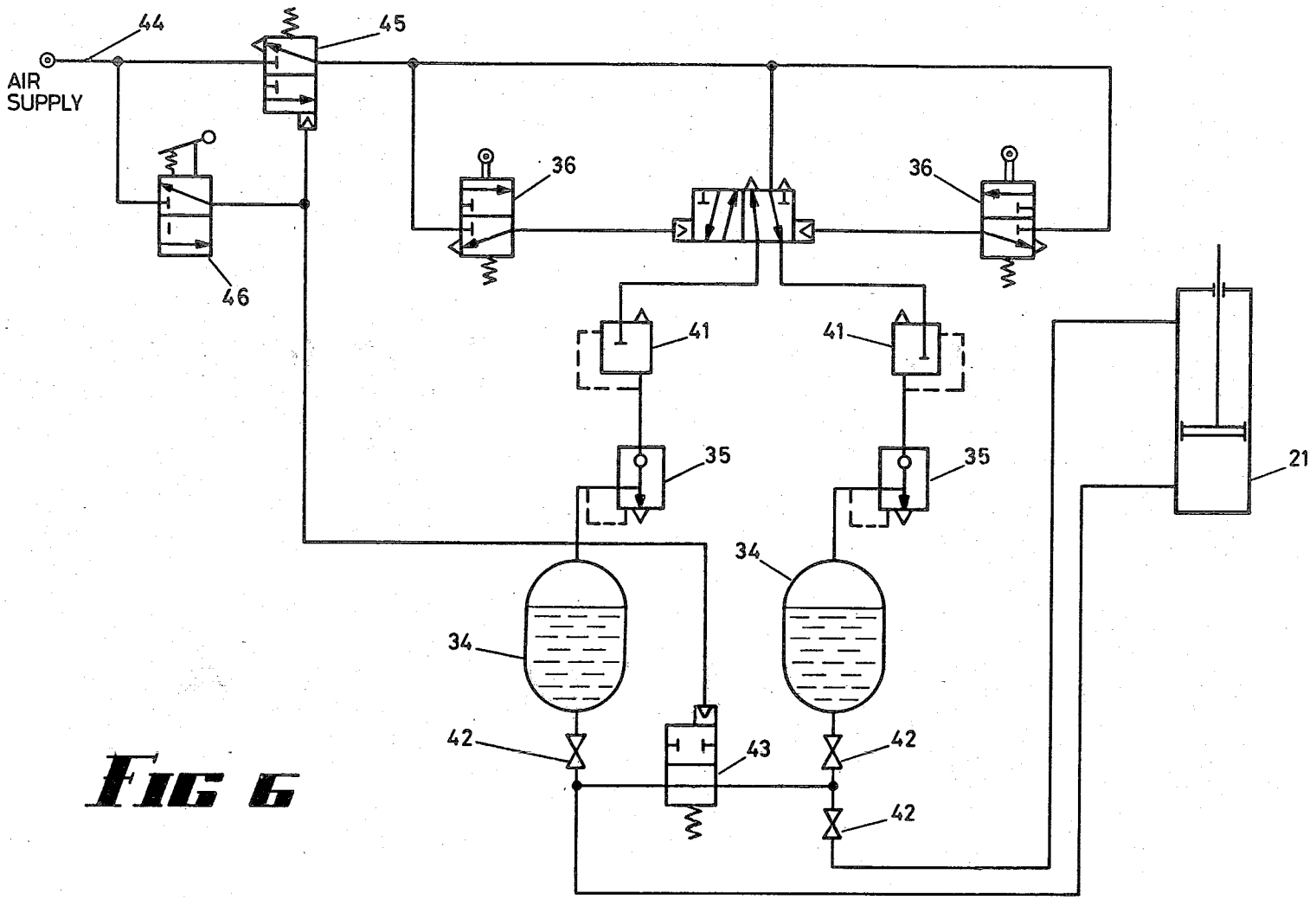
FIG. 6 is a diagrammatic representation of the pneumatic and hydraulic control circuit.

Surprisingly it has been found that this arrangement of tensioned chain and carriers does much to avoid shudder which is undesirable for spray gun movement, but this is still further avoided by use of oil contained in accumulators 34, and the movement of oil is controlled by a pneumatic circuit shown in detail in FIG. 6. The pneumatic circuit includes a pair of quick exhaust valves 35 designated as such by the manufacturer Goyen Controls Co. Pty. Limited, of 82 High St., Northcote, Victoria, Australia, and also a pair of pilot control valves 36 designated by said company as CP 3. These valves 36 are controlled by an actuator plate 37 as shown in FIG. 2, mounted to the carriage 31 or the sprocket carrier 22 thereon. The valves 36 are movable in a vertical direction in a track 38 to which they can be secured in any selected position to control the length of stroke.

Upon operation of one of the valves 36, the double-acting two-way five port pilot operated air valve 40 (Goyen DAB4) causes air to flow through the respective air regulator 41 (Goyen R12) and the respective quick exhaust valve 35 into the respective accumulator 34 causing air to displace the oil in that accumulator, through a shut-off valve 42 into the cylinder 21. The other quick exhaust valve 35 immediately opens, releasing pressure from the opposite side of the ram 21 so that there is no significant dwell at the end of stroke.

Since there is always a possibility of oil leakage, the accumulators 34 are mounted as shown in FIG. 2, side by side, and are interconnected by a pressure operated valve 43 which is closed when pressure is applied from the air supply line 44 but is open at other times to allow the levels to enter the same plane in the two accumulators 34. The valves 45 and 46 perform the function of turning the system ON and OFF. Valve 45 is air pilot operated by valve 46.

Figure 7:
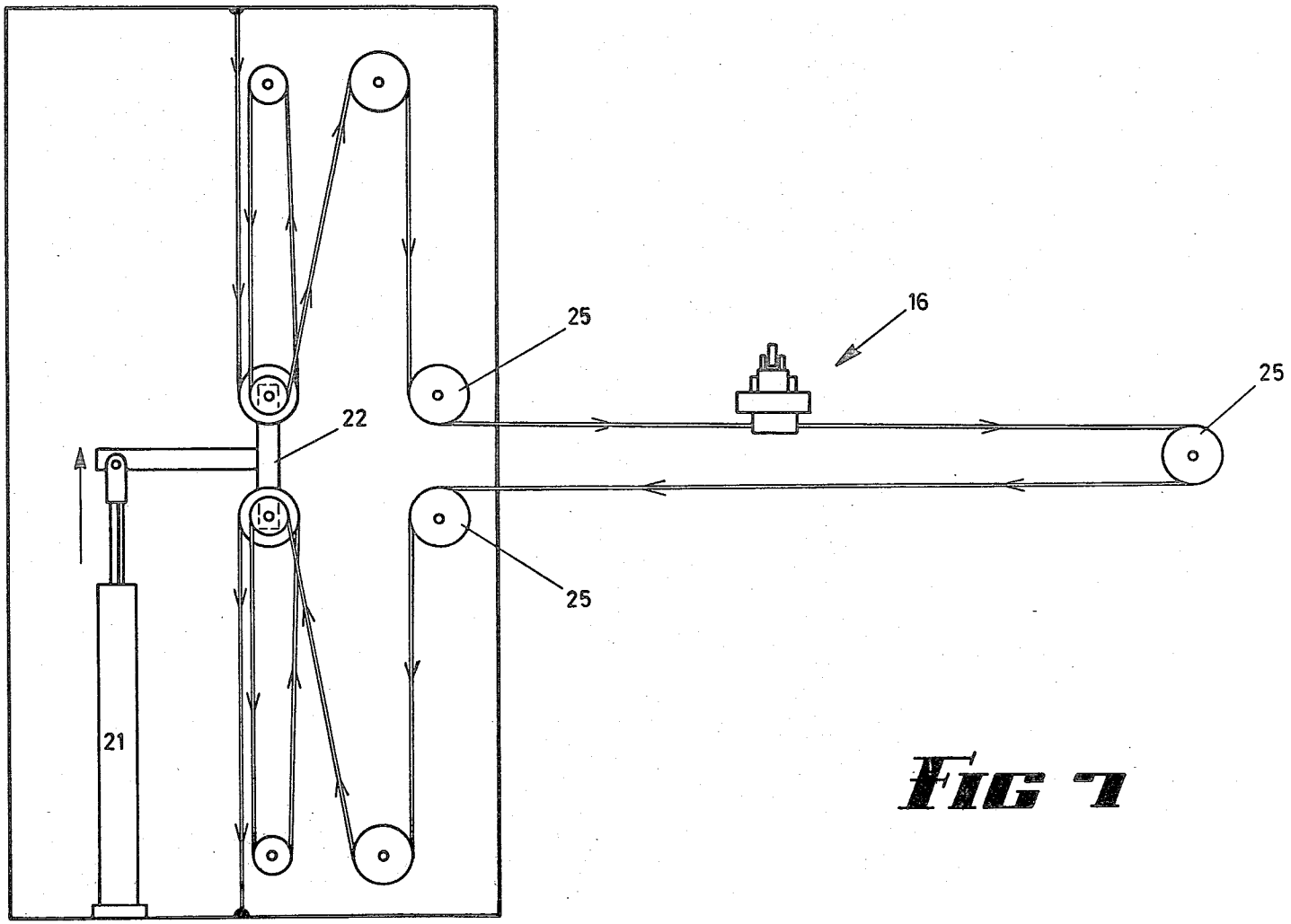
FIG. 7 is a diagrammatic representation of an arrangement wherein a spray gun is moved horizontally by a chain multiplier having a 4:1 ratio.

FIG. 7 illustrates the alternative arrangement if greater movement is required from the chain multiplier which as shown is a 4:1 multiplier, the idler sprockets 25 being spaced apart so that the mounting means 16 will move horizontally.

Figure 8:
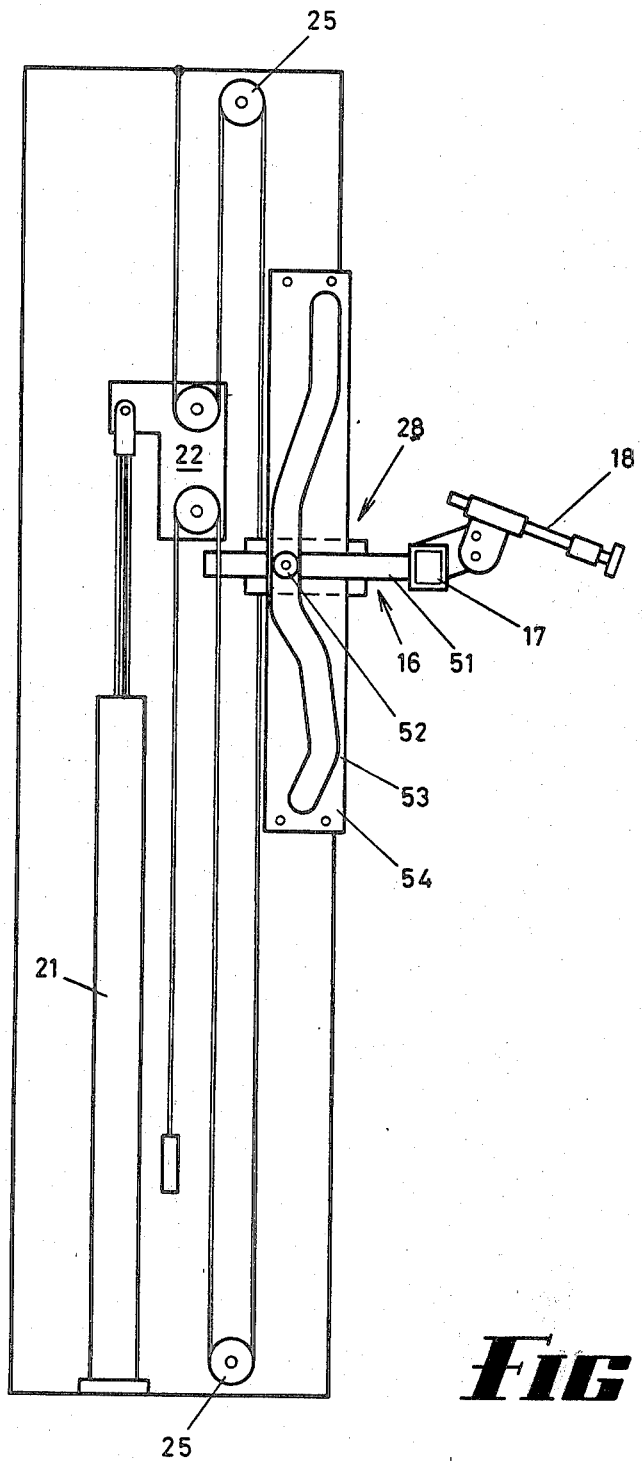
FIG. 8 is a diagrammatic representation corresponding approximately to FIG. 1 but showing a further arrangement wherein use is made of a cam to vary the distance of the gun from the chain multiplier.

FIG. 8 illustrates a further alternative wherein the mounting means 16 comprises a slide 51 secured to the carriage 28, the slide 51 having a cam follower roller 52 which follows a cam track 53 in a cam plate 54 secured to the frame.

It will of course be appreciated that castors can be fitted so that the device can be easily transferred between painting booths or from one end of a booth to the other depending on the work to be painted.

I claim:

1. A spray gun reciprocating device comprising:

a frame, a pressure-fluid actuated ram assembly having two relatively movable sub-assemblies, one said sub-assembly comprising a cylinder and the other said sub-assembly comprising a piston, mounting means securing one of said sub-assemblies to said frame, a twin sprocket carrier on the other said sub-assembly, and a pair of driving sprockets mounted for rotation on said sprocket carrier, a first chain anchor on said frame located at a first position away from said sprocket carrier and a second chain anchor on said frame located at a second position away from said sprocket carrier, at least one of said anchors embodying tension means, idler sprockets mounted for rotation with respect to the frame, a chain having two ends secured to respective said chain anchors and extending over said sprockets to have a portion extending between said idler sprockets, spray gun mounting means secured to said chain portion, a pair of pressure accumulators each containing oil in its lower portion and air in its upper portion, conduit means connecting said accumulator lower portions with respective ends of said cylinder, an air circuit comprising a compressed air inlet conduit, a pilot operated double acting valve, a pair of cam type pilot control air valves interposed between said inlet conduit and pilot operated valve, and further conduit means between said pilot operated air valve and the upper portions of respective said accumulators, such that successive actuation of said pilot operated valve alternately imposes pressure on the oil in the lower portions of respective said accumulators.

2. A spray gun reciprocating device according to claim 1 further comprising a track on the frame, said spray gun mounting means comprising a carriage and rollers on the carriage engaging and guided by the track so that the track guides the carriage for rectilinear movement, and means securing said carriage to said chain portion which extends between said idler sprockets, a cam plate having a cam track, cam securing means securing the cam plate to said frame, a cam follower engaging the cam track, guide means on said carriage, and a guide follower on said spray gun mounting means guiding the mounting means for movement in a direction normal to the direction of said carriage rectilinear movement.

3. A spray gun reciprocating device according to claim 1 further comprising a pair of quick exhaust type air valves in respective said further conduit means between said pilot operated air valve and the upper portions of respective said accumulators.

4. A spray gun reciprocating device according to claim 1 further comprising a pair of air regulators in respective said further conduit means between said pilot operated air valve and respective said quick exhaust valves.

* * * * *